US005638053A

United States Patent [19]

Schuman

[11] Patent Number: 5,638,053

[45] Date of Patent: Jun. 10, 1997

[54] MODEL AIRPLANE CHANNEL EXTENDER

[76] Inventor: David Schuman, 415 Knoch Knolls Rd., Naperville, Ill. 60565

[21] Appl. No.: 413,506

[22] Filed: Mar. 30, 1995

[51] Int. Cl.[6] ..... H04Q 7/00

[52] U.S. Cl. ..... 340/825.03; 340/825.69; 341/176

[58] Field of Search ..... 340/825.03, 825.69, 340/825.72, 825.63; 341/176, 180, 183; 375/238; 446/454, 456; 318/16, 581; 370/9; 434/32

[56] References Cited

U.S. PATENT DOCUMENTS

| | | | |
|---|---|---|---|
| 3,806,939 | 4/1974 | Palmieri | 340/825.69 X |
| 4,177,426 | 12/1979 | Gaishin et al. | 340/825.69 |
| 4,739,311 | 4/1988 | Yamamoto et al. | 340/825.69 X |
| 4,929,949 | 5/1990 | Yamamoto et al. | 341/176 |
| 5,461,373 | 10/1995 | Yamamoto et al. | 340/825.69 |

*Primary Examiner*—Edwin C. Holloway, III

*Attorney, Agent, or Firm*—Wood, Phillips, VanSanten, Clark & Mortimer

[57] ABSTRACT

A channel extender apparatus is provided for use with a radio control system for a controlled device such as a model airplane, model boat, model car or the like. The control system includes a control box housing plural standard input devices, one for each of X channels. An encoder encodes user input commands from the input devices into a standard digital signal. A trainer connector is provided for connection to a similar control box. The trainer connector is connected to the encoder for developing an instructor output to the similar control box and for receiving a trainer input from the similar control box comprising a substitute digital signal. A switch is connected to the encoder and the trainer connector for selecting one of the standard digital signal and the substitute digital signal. A transmitter is connected to the switch for transmitting a through the air signal based on the selected digital signal. A control system associated with the control device includes a receiver capable of receiving data for Y channels, where Y is greater than X and a plurality of servo systems connected to the receiver for controlling operation of controlled elements in the controlled device to operate the same. The channel extender apparatus includes a housing having a cable connectable, in use, to the trainer connector. A receive circuit in the housing is connected via the cable to the instructor output for decoding the standard digital signal for the X channels. A plurality of extended user input devices are one the housing, one for each of Z extended channels. A processing circuit is connected to the receive circuit and the extended user input devices for combining user input commands from the extended user input devices with the decoded standard digital signal to develop the substitute digital signals for the X channels and the Z channels. A modulating circuit connects the processing circuit to the cable to transfer the substitute digital signal to the switch so the transmitter transmits a through the air signal based on the substitute digital signal instead of the standard digital signal.

9 Claims, 3 Drawing Sheets

MODEL AIRPLANE CHANNEL EXTENDER

FIELD OF THE INVENTION

This invention relates to radio control systems for model airplanes, model boats, model cars, or the like and, more particularly, to a channel extender apparatus therefor.

BACKGROUND OF THE INVENTION

Radio control devices such as model airplanes, model boats, model cars or the like, have developed a considerable following in the marketplace. A typical model airplane, for example, includes a plurality of servo control devices such as throttle, rudder, aileron and elevator. While such systems could be directly controlled by a hardwired hand-held control device, this would severely limit the freedom of flying. Preferably, the airplane is controlled by a radio control system.

Such a radio control system includes a hand-held control box. The box houses plural input devices such as joysticks and trim tabs. The position of these input devices is varied to control operation of the airplane. The control box further houses an encoder which encodes user input commands from the input device into a digital signal conveyed to a transmitter. The transmitter transmits a through the air signal based on the digital signal. The model airplane includes a receiver receiving the transmitted signal and using the received signal to control the servo devices.

Digital proportional radio control systems have become popular to control the previously described devices such as model airplanes, boats and cars. Commercially available DPRC systems range from as few as two channels to as many as eight channels. Each channel is associated with controlling a servo system in the controlled device. For example, controlling an engine's throttle requires a separate channel.

A typical control box includes four channels for controlling throttle, rudder, ailerons and elevator. The associated model airplane would include a servo motor and system for each of these controlled elements.

As a model airplane flyer becomes more adept, there may be a desire to enhance the features of the airplane as by adding additional servo systems or to provide more sophisticated control. The typical receiver is capable of interfacing with such additional servo systems. However, the control box is limited due to the number of user input devices included thereon. Thus, to upgrade a model airplane has heretofore required the purchase of an entire new control box including a greater number of input devices and channels, as well as the basic encoder and transmitter. Doing so can be prohibitively expensive.

The present invention is directed to solving one or more of the problems discussed above in a novel and simple manner.

SUMMARY OF THE INVENTION

In accordance with the invention a channel extender apparatus is provided for adding additional channels to a radio control system.

Broadly, there is disclosed herein a channel extender apparatus for use with a radio control system for a controlled device such as a model airplane, model boat, model car, or the like. The system includes a control box housing plural standard input devices, one for each of X channels. An encoder encodes user input commands from the user input devices into a standard digital signal. A transmitter is connected to the encoder for transmitting a through the air signal based on the standard digital signal. A control system associated with the control device includes a receiver capable of receiving data for Y channels, where Y is greater than X. A plurality of servo systems are connected to the receiver for controlling operation of controlled elements in the controlled device to operate the same. The channel extender apparatus includes a receive circuit connectable to the encoder, in use, for decoding the digital signal for the X channels. A plurality of extended user input devices are provided, one for each of Z extended channels. Processing means are connected to the receive circuit and the extended user input devices for combining user input commands from the extended user input devices with the decoded standard digital signal to develop an augmented digital signal for the X channels and the Z channels. Means are provided for transferring the augmented digital signal to the transmitter so that the transmitter transmits a through the air signal based on the augmented digital signal instead of the standard digital signal.

In one aspect of the invention the standard digital signal comprises a serial pulse train signal and the receive circuit comprises a pulse width demodulator circuit outputting an electrical signal for each of the X channels representing the user input commands.

In accordance with another aspect of the invention, the pulse train signal includes a pulse for each channel within a frame and the receive circuit further comprises a frame detector circuit for determining the beginning of each frame for use by the pulse width demodulator.

In accordance with a still further aspect of the invention, the processing means includes a pulse width modulation circuit receiving an electrical signal for each of the X channels and the Z channels and developing a serial pulse train signal.

In accordance with yet a further aspect of the invention, an enclosure houses the extended user input devices, the receive circuit and the processing means, and the transferring means comprises an electrical cable extending between the control box and the enclosure.

In accordance with another embodiment of the invention, a channel extender apparatus is provided for use with a radio control system for a controlled device such as a model airplane, model boat, model car or the like. The control system includes a control box housing plural standard input devices, one for each of X channels. An encoder encodes user input commands from the input devices into a standard digital signal. A trainer connector is provided for connection to a similar control box. The trainer connector is connected to the encoder for developing an instructor output to the similar control box and for receiving a trainer input from the similar control box comprising a substitute digital signal. A switch is connected to the encoder and the trainer connector for selecting one of the standard digital signal and the substitute digital signal. A transmitter is connected to the switch for transmitting a through the air signal based on the selected digital signal. A control system associated with the control device includes a receiver capable of receiving data for Y channels, where Y is greater than X and a plurality of servo systems connected to the receiver for controlling operation of controlled elements in the controlled device to operate the same. The channel extender apparatus includes a housing having a cable connectable, in use, to the trainer connector. A receive circuit in the housing is connected via the cable to the instructor output for decoding the standard digital signal for the X channels. A plurality of extended user input devices are one the housing, one for each of Z extended channels. Processing means are connected to the receive circuit and the extended user input devices for combining user input commands from the extended user input devices with the decoded standard digital signal to develop the substitute digital signals for the X channels and the Z channels. Means are provided for connecting the processing means to the cable to transfer the substitute digital signal to the switch so the transmitter transmits a through the air signal based on the substitute digital signal instead of the standard digital signal.

Further features and advantages of the invention will readily be apparent from the specification and from the drawings.

DETAILED DESCRIPTION OF THE INVENTION

Figure 1:
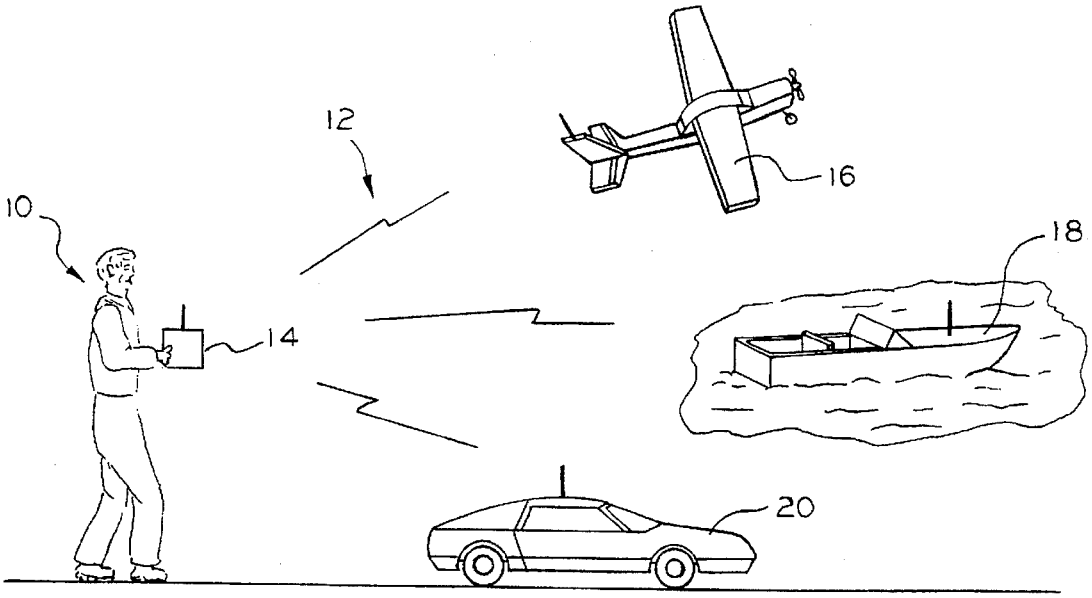
FIG. 1 is a perspective view of a user operating a digital proportional radio control system according to the invention.

Referring initially to FIG. 1, a user 10 is illustrated operating a digital proportional radio control (DPRC) system 12. The system 12 includes a hand-held control box 14 for controlling a controlled device such as a model airplane 16, model boat 18, or model car 20 or the like.

The present invention is not directed to the particular features of the plane 16, boat 18, or car 20. Instead, the invention is particularly directed to a channel extender apparatus for augmenting the capability of the system via the control box 14.

Figure 2:
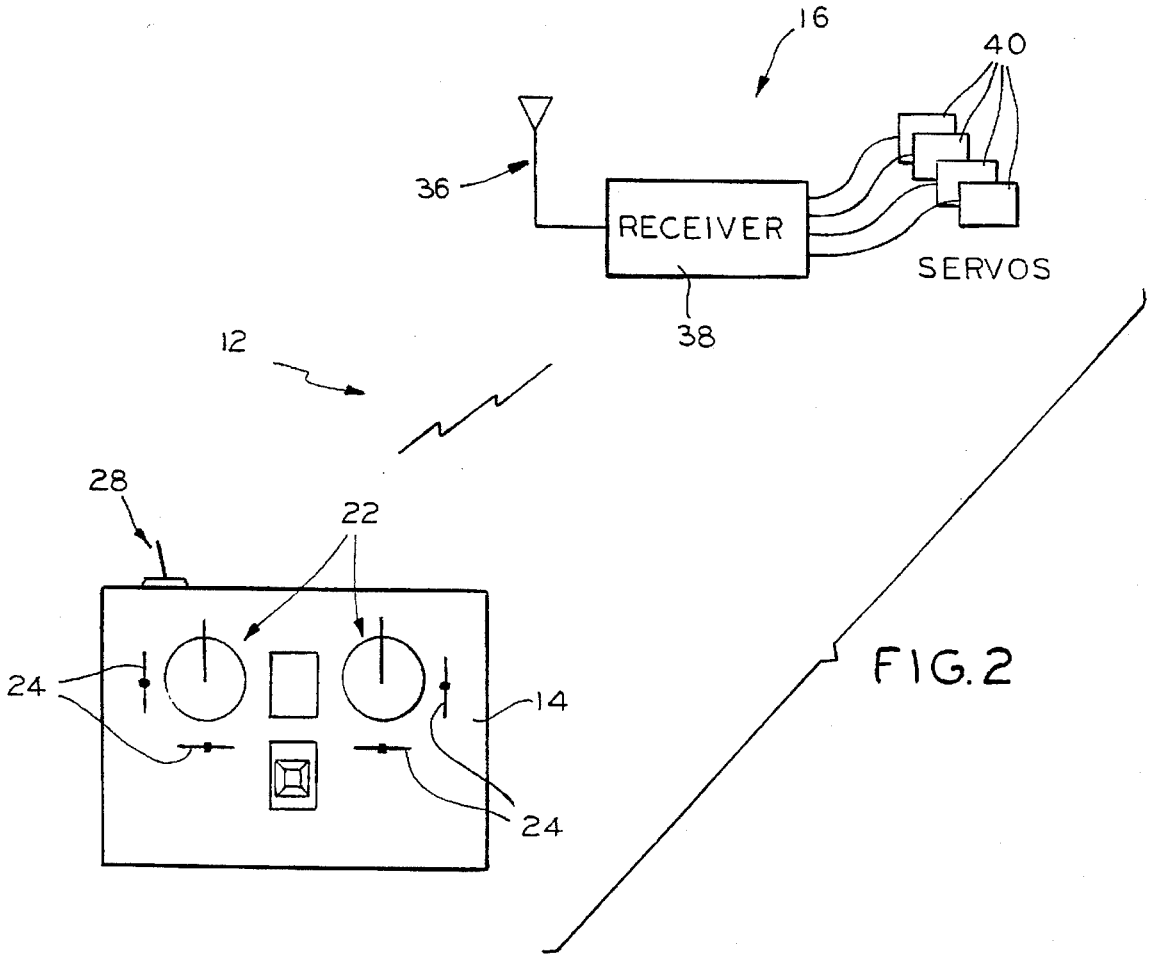
FIG. 2 is a combined generalized/block diagram of the system of FIG. 1.

Referring now to FIG. 2, the system 12 is illustrated in greater detail for a typical application of controlling a model airplane. The control box 14 houses a pair of channel control joysticks 22. Each joystick 22 controls two channels. Moving the joystick in the x direction, i.e., sideways, controls one channel, while movement in the y direction, i.e., up or down, controls the second channel. In addition, a neutral or central position of each joystick channel can be adjusted by trim tabs 24 located next to each joystick 22.

Figure 3:
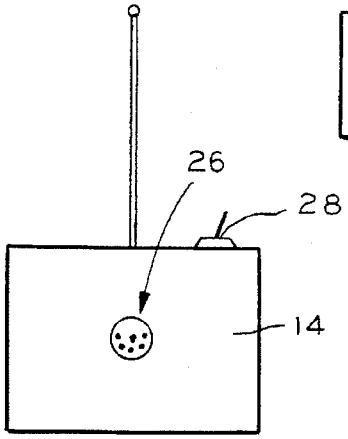
FIG. 3 is a rear elevation view of a control box of FIG. 2.

Referring also to FIG. 3, a trainer system connector 26 is provided on the back side of the control box 14. The trainer system connector allows a novice to connect the control box 14 to an instructor's control box over a cable (not shown). If, at some time, the novice loses control of the controlled device 16, the novice can flick an instructor switch 28, allowing the instructor to take over and attempt to recover control.

Figure 4:
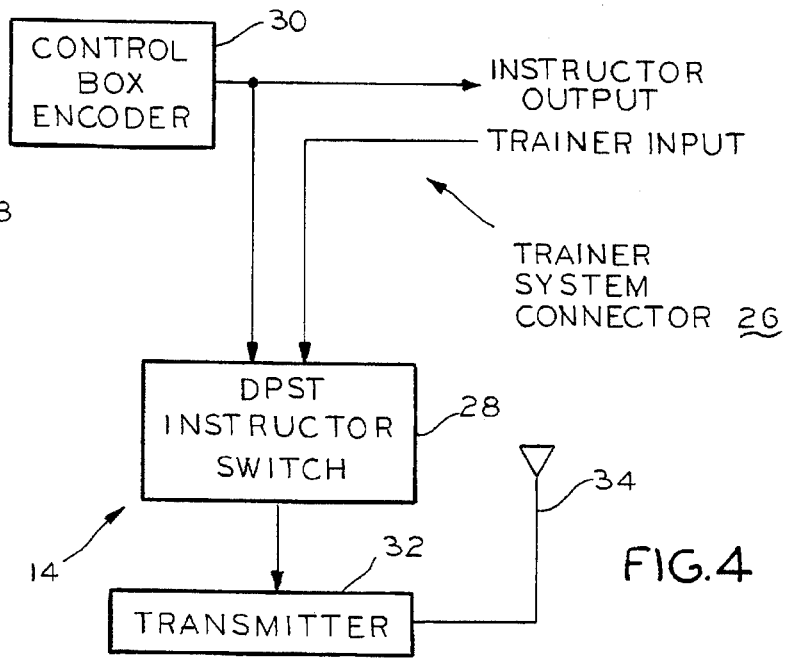
FIG. 4 is a block diagram of an electrical circuit in the control box of FIG. 2.
Figure 8:
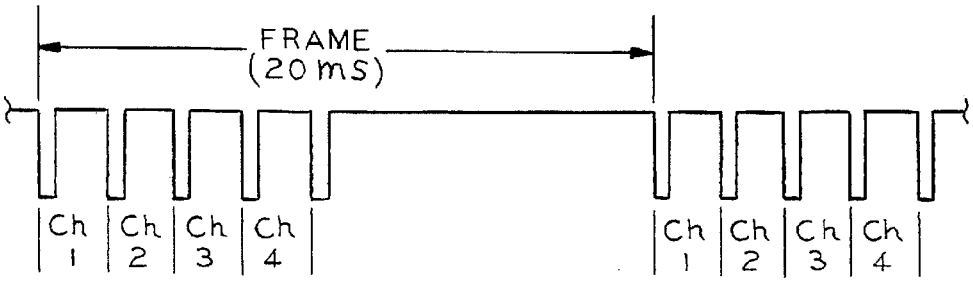
FIG. 8 is a timing diagram illustrating a through the air transmitted signal developed by the control box of FIG. 2.

Referring also to FIG. 4, a block diagram for a circuit in the control box 14 is illustrated. The control box includes an encoder 30. The control box encoder 30 is connected to the user input devices 22 and 24 and encodes user commands therefrom into a standard digital signal including a series of digital pulses. Such a standard digital signal for a four channel device is illustrated in FIG. 8. The standard digital signal comprises a serial pulse train signal, with the pulse width for each signal being proportional to the user command for the particular channel. The pulse train signal is continually developed within a frame illustrated as a twenty millisecond frame.

The encoder 30 transfers the standard digital signal, see FIG. 8, to the trainer system connector 26 as an instructor output. The standard digital signal is also connected via an instructor switch 28, comprising a double pole single throw switch, to a transmitter circuit 32. The transmitter 32 transmits the signal via an antenna 34, through the air, to the controlled device 16. Thus, each twenty milliseconds the serial signal of FIG. 8 is retransmitted based on the then current user commands as determined by the encoder 30. Particularly, using pulse width modulation the control box 14 sequentially places each channel command into a serial stream frame. The control box 14 continuously transmits the frame to the airplane 16 approximately 50 times each second Referring particularly to FIG. 2, the model airplane 16 likewise includes an antenna 36 connected to a receiver 38. The receiver 38 receives the transmitted digital signal and decodes the signal for operating plural servo systems 40. Each servo system 40 includes a servo motor for controlling an appropriate controlled element, such as throttle, rudder, ailerons and elevator. While the airplane 16 is shown to include four servo systems, the receiver 38 is capable of receiving dam for greater than four channels. Likewise, the transmitter circuit 32 is capable of transmitting a signal for more than four channels dependent on the available system frame time. However, the control box 14 is limited in that the encoder 30 is configured to operate only with the included input devices 22 and 24 so that only four channels are actually transmitted. If greater than four channels are necessary for control, then this previously required purchasing a new control box for a greater number of channels.

Referring again to FIG. 4, the trainer system connector 26 also receives a trainer input from the trainers control box which comprises a substitute digital signal. The substitute digital signal is provided to the instructor switch 28. The instructor switch 28 determines which of the standard digital signal and substitute digital signal are transferred to the transmitter 32 for controlling the airplane 16. In actuality, the trainer's control box is generally identical to the user's control box 14. The switch 28 simply determines which of the users assumes control for the available channels to be controlled.

Figure 5:
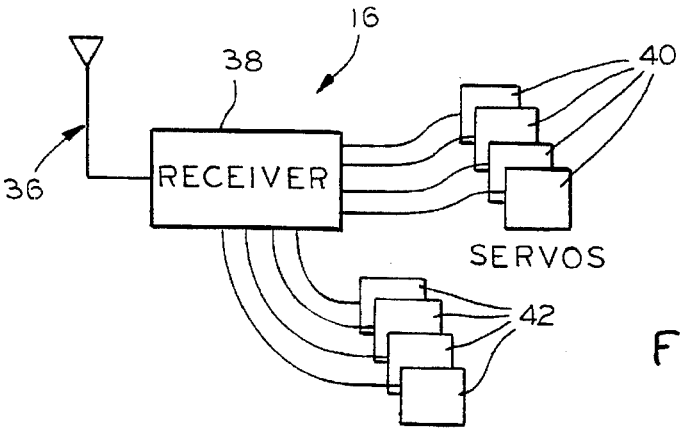
FIG. 5 is a block diagram similar to that in FIG. 2 showing an enhanced controlled device.

Referring to FIG. 5, it may be desired to enhance the control device 16 to control a greater number of channels than four or more sophisticated processing of the existing channels. This is accomplished initially by providing additional servo systems 42 also connected to the receiver 38. Rather than requiring the user to purchase a new control box, the operation of the control box 14 can be augmented using a channel extender apparatus 44 according to the invention. The channel extender apparatus 44 includes a control housing or enclosure 46 having a cable 48 connectable via a suitable connector 50 to the trainer connector 26. The housing 46, in the illustrated embodiment, houses four extended user input devices 52 which may take any known form, one for each of four extended channels.

Figure 6:
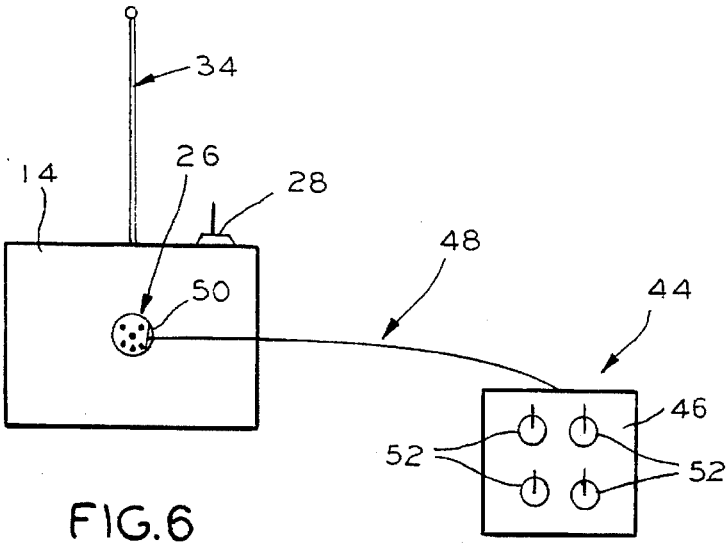
FIG. 6 is a diagram similar to that of FIG. 3 showing a channel extender apparatus connected to the control box.
Figure 7:
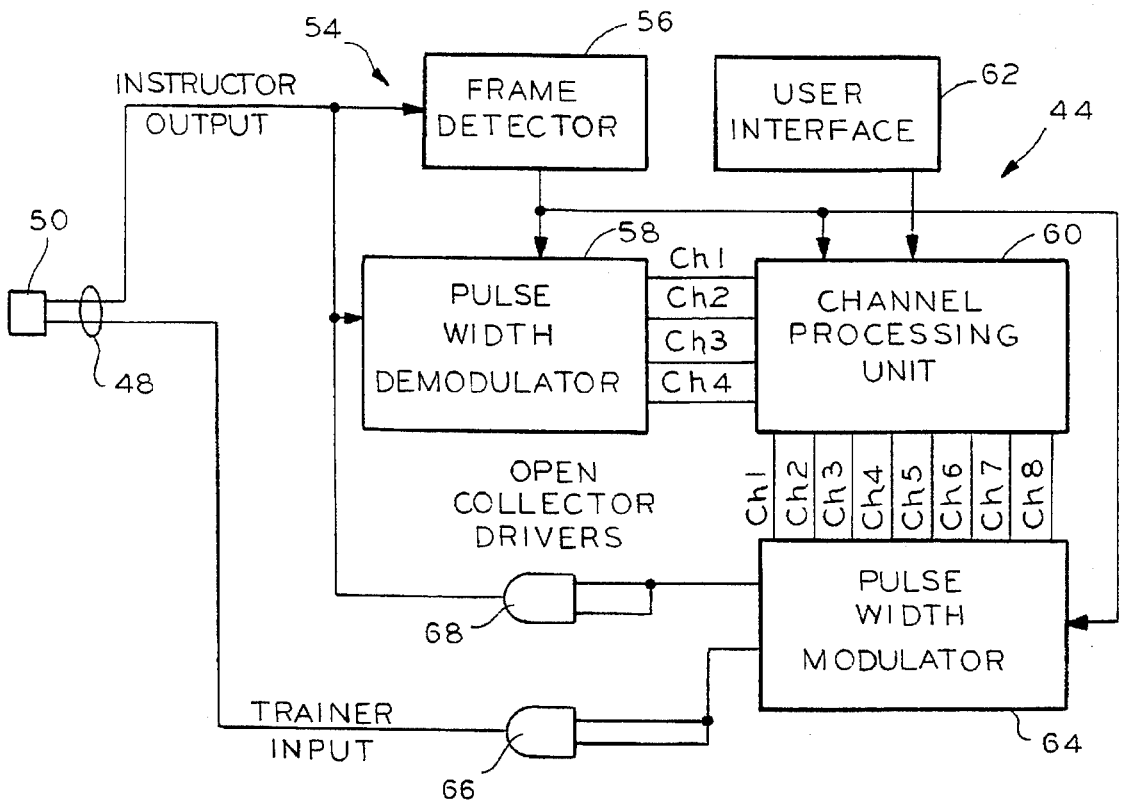
FIG. 7 is a block diagram for a circuit in the extender apparatus of FIG. 6.

Referring to FIG. 7, a block diagram for a circuit in the extender apparatus 44 is illustrated. In use, the connector 50 is connected to the trainer connecter 26, as shown in FIG. 6. The instructor output from the control box, see FIG. 4, is received by a receive circuit 54 comprising a frame detector circuit 56 and pulse width demodulator circuit 58. The frame detector circuit 56 receives the instructor output comprising the standard digital signal of FIG. 8, and locates the first pulse for channel 1 within the frame. The indication of the first pulse is indicated to the pulse width demodulator circuit 58. The pulse width demodulator circuit 58 takes the pulse width modulated instructor output and demodulates the signal into its constituent four channels. Signals for the four channels are then transferred to a channel processing unit 60. The channel processing unit 60 is also connected to a standard user interface circuit 62. The user interface circuit 62 converts the signals from the user input devices 52 of FIG. 6 to appropriate electrical signals for use by the channel processing unit 60. The channel processing unit takes the demodulated output of the pulse width modulator circuit 58 and the signals from the user interface circuit 62 and applies the following function to generate its output:

$$Co(n) = I(n) + \sum_{x=1}^{8} F_{n,x}(Ci(x))$$

Where $Co_0$ is the channel output of the Channel Processing Unit and n is the channel number. $I_0$ is an initial channel output value and can be either predefined or set by the user through the user interface. $Ci_0$ is either the output of the pulse width demodulator or one of the new channels defined through the user interface $F_{n,x0}$ is either a predefined or user defined function. The variable x goes from 1 to the number of outputs—in this example, there are eight outputs.

Figure 9:
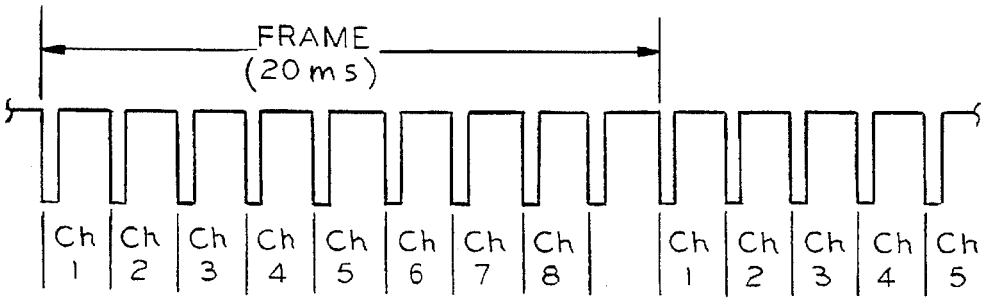
FIG. 9 is a timing diagram similar to that of FIG. 8 illustrating an augmented digital signal developed by the extender apparatus of FIG. 6.

The eight channel outputs are then transferred to a pulse width modulator circuit 64 which generates a serial stream frame output comprising an augmented digital signal. This signal is illustrated in FIG. 9. This substitute digital signal is transferred via open collector driver circuits 66 to the trainer input and 68 to the instructor output. As such, flipping the instructor switch 28, see FIG. 6, to the instructor position allows the control box 14 to transmit to the device 16 whatever appears at the trainer input, i.e., the augmented digital signal. The output of the pulse width modulator circuit 64 is also connected via open collector driver circuit 68 to the instructor input. This is another method of providing information to the transmitter 32, see FIG. 4, as by multiplexing additional channels onto the instructor output at the appropriate time. The appropriate timing of doing so is controlled by also connecting the frame detector circuit 56 to the pulse width modulator circuit 64 so that the input and output signals are in synch. Doing so eliminates the requirement to use the instructor switch 28.

Thus, in accordance with the invention, the channel extender apparatus receives and demodulates the encoded standard digital signal and augments the signal by adding modulated pulses for additional channels or more sophisticated controls so that additional channel control can be provided relatively inexpensively. Particularly, there is no need to purchase an entire new control box with its transmitter, antenna and basic control input devices. Instead, the existing elements may continue to be used and a less expensive extender apparatus purchased to augment the capability of the control module 14.

I claim:

1. For use with a radio control system for a controlled device such as a model airplane, model boat, model car, or the like, including a control box housing plural standard input devices, one for each of X channels, an encoder for encoding user input commands from the input devices into a standard digital signal and a transmitter connected to the encoder for transmitting a through the air signal based on the standard digital signal, and a control system associated with the controlled device including a receiver capable of receiving data for Y channels, where Y is greater than X, and a plurality of servo systems connected to the receiver for controlling operation of controlled elements in the controlled device to operate the same, a channel extender apparatus comprising:

a receive circuit connectable to the encoder, in use, for decoding the digital signal for the X channels;

a plurality of extended user input devices, one for each of Z extended channels;

processing means connected to the receive circuit and the extended user input devices for combining user input commands from the extended user input devices with the decoded standard digital signal to develop an augmented digital signal for the X channels and the Z channels; and means for transferring the augmented digital signal to the transmitter so that the transmitter transmits a through the air signal based on the augmented digital signal instead of the standard digital signal.

2. The channel extender apparatus of claim 1 wherein said standard digital signal comprises a serial pulse train signal and said receive circuit comprises a pulse width demodulator circuit outputting an electrical signal for each of the X channels representing the user input commands.

3. The channel extender apparatus of claim 2 wherein the pulse train signal includes a pulse for each channel within a frame and the receive circuit further comprises a frame detector circuit for determining the beginning of each frame for uses by the pulse width demodulator.

4. The channel extender apparatus of claim 1 wherein said processing means includes a pulse width modulation circuit receiving an electrical signal for each of the X channels and the Z channels and developing a serial pulse train signal.

5. The channel extender apparatus of claim 1 further comprising an enclosure housing the extended user input devices, the receive circuit and the processing means, and the transferring means comprises an electrical cable extending between the control box and the enclosure.

6. For use with a radio control system for a controlled device such as a model airplane, model boat, model car, or the like, including a control box housing plural standard input devices, one for each of X channels, an encoder for encoding user input commands from the input devices into a standard digital signal, a trainer connector for connection to another said control box, the trainer connector being connected to the encoder for developing an instructor output to the other said control box and for receiving a trainer input from the other said control box comprising a substitute digital signal, a switch connected to the encoder and the trainer connector for selecting one of the standard digital signal and the substitute digital signal, and a transmitter connected to the switch for transmitting a through the air signal based on the selected digital signal, and a control system associated with the controlled device including a receiver capable of receiving data for Y channels, where Y is greater than X, and a plurality of servo systems connected to the receiver for controlling operation of controlled elements in the controlled device to operate the same, a channel extender apparatus comprising:

a housing having a cable connectable, in use, to the trainer connector;

a receiver circuit in the housing connected via the cable to the instructor output for decoding the standard digital signal for the X channels;

a plurality of extended user input devices on the housing, one for each of Z extended channels;

processing means connected to the receiver circuit and the extended user input devices for combining user input commands from the extended user input devices with the decoded standard digital signal to develop the substitute digital signal for the X channels and the Z channels; and means for connecting the processing means to the cable to transfer the substitute digital signal to the switch so that the transmitter transmits a through the air signal based on the substitute digital signal instead of the standard digital signal.

7. The channel extender apparatus of claim 6 wherein said standard digital signal comprises a serial pulse train signal and said receive circuit comprises a pulse width demodulator circuit outputting an electrical signal for each of the X channels representing the user input commands.

8. The channel extender apparatus of claim 7 wherein the pulse train signal includes a pulse for each channel within a frame and the receive circuit further comprises a frame detector circuit for determining the beginning of each frame for uses by the pulse width demodulator.

9. The channel extender apparatus of claim 6 wherein said processing means includes a pulse width modulation circuit receiving an electrical signal for each of the X channels and the Z channels and developing a serial pulse train signal.

* * * * *